US010890156B2

(12) United States Patent
Wüstenhagen et al.

(10) Patent No.: US 10,890,156 B2
(45) Date of Patent: Jan. 12, 2021

(54) METHOD FOR DETERMINING A NEED FOR CHANGING A SPARK PLUG

(71) Applicants: Dirk Wüstenhagen, Auma (DE); Dejan Kienzle, Heilbronn (DE); Douglas Sprunger, Columbus, IN (US)

(72) Inventors: Dirk Wüstenhagen, Auma (DE); Dejan Kienzle, Heilbronn (DE); Douglas Sprunger, Columbus, IN (US)

(73) Assignees: BorgWarner Ludwigsburg GmbH, Ludwigsburg (DE); Cummins Inc., Indianapolis, IN (US)

( * ) Notice: Subject to any disclaimer, the term of this patent is extended or adjusted under 35 U.S.C. 154(b) by 0 days.

(21) Appl. No.: 15/613,527

(22) Filed: Jun. 5, 2017

(65) Prior Publication Data

US 2017/0350364 A1 Dec. 7, 2017

Related U.S. Application Data

(60) Provisional application No. 62/346,950, filed on Jun. 7, 2016.

(51) Int. Cl.

| | |
|---|---|
| ***F02P 17/12*** | (2006.01) |
| ***F02P 3/04*** | (2006.01) |
| ***F02P 11/02*** | (2006.01) |
| ***H01T 13/60*** | (2011.01) |
| *F02P 3/045* | (2006.01) |

(52) U.S. Cl.

CPC ..... *F02P 17/12* (2013.01); *F02P 3/04* (2013.01); *F02P 3/0407* (2013.01); *F02P 11/02* (2013.01); *H01T 13/60* (2013.01); *F02P 3/0453* (2013.01)

(58) Field of Classification Search

CPC .. F02P 3/04; F02P 3/0453; F02P 11/02; F02P 17/12; F02P 17/121

USPC ..... 324/378, 379, 393, 397, 399

See application file for complete search history.

(56) References Cited

U.S. PATENT DOCUMENTS

| | | | | |
|---|---|---|---|---|
| 4,176,645 | A * | 12/1979 | Jundt | F02P 3/0453 123/609 |
| 5,263,451 | A * | 11/1993 | Andreasson | F02D 41/22 123/406.26 |
| 5,418,461 | A * | 5/1995 | Maeda | F02P 17/12 123/479 |
| 5,510,715 | A | 4/1996 | Takeuchi | |
| 5,925,819 | A * | 7/1999 | Yoshinaga | F02P 17/12 324/399 |
| 6,202,474 | B1 * | 3/2001 | Takahashi | G01L 23/221 324/378 |

(Continued)

FOREIGN PATENT DOCUMENTS

| | | |
|---|---|---|
| JP | 2001295743 A | 10/2001 |
| JP | 2009156143 A | 7/2009 |

*Primary Examiner* — Steven L Yeninas

(74) *Attorney, Agent, or Firm* — Bose McKinney & Evans LLP

(57) ABSTRACT

A method for determining a need for changing a spark plug of a combustion engine, comprising the following steps: monitoring a current flowing through the spark plug, analyzing the current and thereby determine a time interval that is indicative for the time between application of a voltage to the spark plug and formation of an arc discharge between electrodes of the spark plug, creating a signal indicative of the need to change the spark plug if the duration of the determined time interval is outside predefined bounds.

5 Claims, 4 Drawing Sheets

(56) References Cited

U.S. PATENT DOCUMENTS 6,222,368 B1* 4/2001 Inagaki ..... F02P 17/12 324/399
6,408,242 B1* 6/2002 Tozzi ..... F02D 35/021 324/399
6,492,818 B1 12/2002 Downs
6,512,375 B1* 1/2003 Yamada ..... F02P 17/12 324/384
6,813,933 B1* 11/2004 Ketterer ..... F02P 17/12 123/644
2001/0039941 A1* 11/2001 Yamada ..... F02D 37/02 123/406.14
2002/0079900 A1* 6/2002 Inagaki ..... F02P 3/051 324/378
2004/0084034 A1* 5/2004 Huberts ..... F02P 3/045 123/630
2006/0030993 A1* 2/2006 Goodell ..... F02P 3/02 701/114
2007/0186903 A1* 8/2007 Zhu ..... F01N 3/2006 123/406.37
2009/0013772 A1* 1/2009 Asano ..... F02D 35/021 73/114.67
2009/0066337 A1* 3/2009 Gibson ..... F01L 1/34 324/378
2009/0099722 A1* 4/2009 Tanaya ..... F02P 15/02 701/33.6
2010/0242583 A1* 9/2010 Chesney ..... F02P 11/06 73/114.62
2011/0041803 A1* 2/2011 Qu ..... F02P 15/10 123/406.2
2013/0199485 A1* 8/2013 Shibata ..... F02P 17/12 123/146.5 R
2013/0206106 A1* 8/2013 Huberts ..... F02B 77/08 123/406.27
2015/0112573 A1* 4/2015 Huberts ..... F02P 17/12 701/102
2015/0144101 A1* 5/2015 Deguchi ..... F02P 3/02 123/406.13
2015/0176508 A1* 6/2015 Glugla ..... F02D 41/30 123/332
2015/0316019 A1* 11/2015 Kimura ..... F02P 9/002 123/406.19
2015/0340846 A1* 11/2015 Schultz ..... F02P 3/0807 123/146.5 R
2016/0084214 A1 3/2016 Okuda
2017/0045025 A1* 2/2017 Nakayama ..... F02P 3/051
2017/0284358 A1* 10/2017 Skowronek ..... F02P 9/002
2017/0314524 A1* 11/2017 Hoban ..... F02P 17/12
2018/0202411 A1* 7/2018 Silva ..... F02P 3/0442

* cited by examiner

METHOD FOR DETERMINING A NEED FOR CHANGING A SPARK PLUG

RELATED APPLICATIONS

This application claims priority to U.S. Provisional Patent Application Ser. No. 62/346,950, filed Jun. 7, 2016, which is hereby incorporated herein by reference in its entirety.

BACKGROUND

The present invention relates to a method for determining the need for changing a spark plug of a combustion engine.

The service life of spark plugs is limited. Spark plugs usually fail due to wear, especially erosion of electrodes, or build up of deposits. In order to prevent failure during operation spark plugs are usually exchanged at defined service intervals. However, this is not ideal. On the one hand, failure of spark plugs during operation cannot be entirely prevented. On the other hand spark plugs are sometimes exchanged, even though they show little wear and may still have useful service life left. There is therefore a need to detect an imminent failure of a spark plug. Thus there is also a need for detecting when a spark plug should be changed.

SUMMARY

This disclosure teaches a method for determining a need for changing a spark plug of a combustion engine. In the method of this disclosure, a current that flows through the spark plug is monitored and analyzed in order to determine a time interval that is indicative for the time between application of a voltage to the spark plug and formation of an arc discharge between electrodes of the spark plug.

The inventors have noted that the time between application of a voltage and formation of an arc discharge increases with increased wear of the spark plug. The longer the time that passes between application of the voltage to the spark plug and formation of an arc discharge between electrodes of the spark plug, the lower is the remaining useful service life of the spark plug. By comparing this time or a time interval that is indicative for the time that passes between application of the voltage to the spark plug and formation of an arc discharge with a threshold value it is therefore possible to determine whether there is a need to replace the spark plug. If the duration of the time interval determined by monitoring and analyzing the current flowing through the spark plug is outside of predefined bounds, which may be provided by a manufacturer of the spark plug, a signal is created which indicates that the spark plug needs to be changed. Such a signal may for example be provided as a visible signal, e.g., a control light, in order to inform the operator of the engine.

Wear, especially electrode erosion, causes the time that passes between application of a voltage and formation of an arc discharge to increase. Build-up of deposits may cause shortening of the time that passes between application of a voltage and formation of an arc discharge.

The voltage applied to a spark plug is usually provided by means of a transformer that converts a primary voltage into a secondary voltage that is then applied to the spark plug. When the primary voltage is switched off a large secondary voltage is induced and applied to the spark plug. Thus, the switching off of the primary voltage can be used to define the start of the time interval that is indicative for the time that passes between the time when a voltage is applied to the spark plug and the time when an arc discharge forms between electrodes of the spark plug.

It is also possible to define the start of the interval that is indicative for the time between application of a voltage to the spark plug and formation of an arc discharge by monitoring and analyzing the current flowing through the spark plug. When a voltage is applied to the spark plug the current between the electrodes of the spark plug increases at first slowly until break through occurs and an arc discharge forms. The start of the time interval can therefore be defined by the current surpassing a predefined threshold value.

The end of the time interval that is indicative for the time that passes between application of a voltage to the spark plug and formation of an arc discharge can be defined by the current or a time derivative of the current surpassing a threshold, or by a maximum of the current, for example. Another possibility is to define the end of the time interval by a maximum of a time derivative of the current.

The maximum of the current or of the time derivative of the current can be a global maximum, but may also be only a local maximum, especially in cases where an arc discharge is created several times within a single motor cycle. The time derivative may be the first time derivative and may be calculated numerically.

The maximum of the current or of the time derivative of the current may be found by a hill climbing algorithm that is triggered whenever the current or the time derivative of the current surpasses a predefined threshold. In order to increase the chances of finding a global maximum and not just a local maximum it is possible to use two or even more predefined thresholds and to start a hill climbing algorithm also when a further threshold is surpassed by the current or the time derivative of the current. Each threshold then yields a maximum. The highest of these maxima can be used to define the end of the time interval that is indicative for the time that passes between application of a voltage to the spark plug and formation of an arc discharge.

In the context of this disclosure, it should be noted that the time interval determined within a method of this disclosure may precisely correspond to the time that passes between the application of a voltage to the spark plug and the formation of an arc discharge, but such precision is not necessary. The time interval may well differ systematically from the time that passes between application of a voltage to the spark plug and formation of an arc discharge between electrodes of the spark plug, e.g., it may be systematically somewhat shorter or longer. It is sufficient if the time interval determined in accordance with this disclosure increases when the time between application of a voltage for the spark plug and formation of an arc discharge increases.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
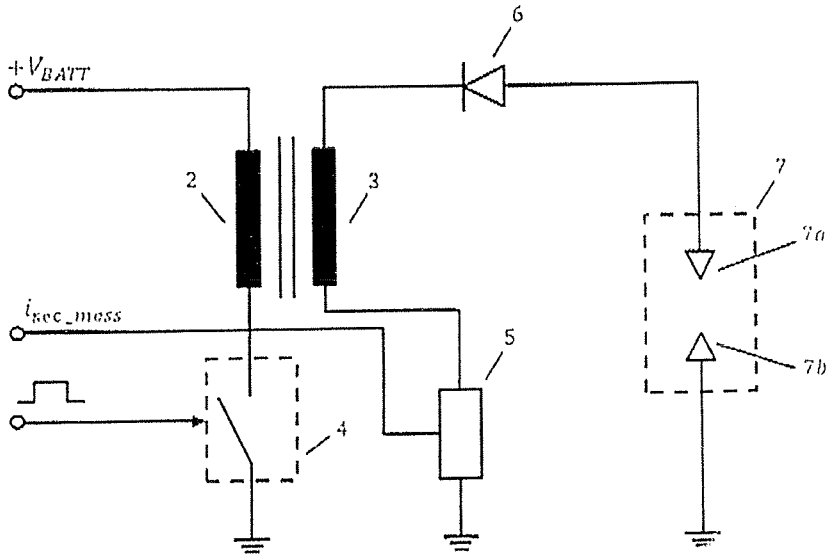
FIG. 1 shows a circuit diagram of an ignition system.

The circuit shown in FIG. 1 comprises a transformer with a primary coil 2 and a secondary coil 3, a switch 4 and a spark plug 7 with electrodes 7*a* and 7*b*. When switch 4 is closed, the battery voltage $V_{Batt}$ is applied to the primary coil 2 and a primary current begins to flow through the primary coil 2. This primary current induces a voltage in the secondary coil 3. A diode 6 can be included in the ignition system in order to prevent this voltage from being applied to the spark plug 7 and causing an unintended formation of an arc between the electrodes 7*a*, 7*b* and the spark plug 7. Sparking is triggered by opening switch 4. This causes the primary current to stop and a high secondary voltage to be induced in a secondary coil 3. Thus, the secondary voltage is applied to the spark plug 7 so that an arc discharge forms between the electrodes 7*a*, 7*b* of the spark plug 7. Thus, a secondary current flows through the spark plug 7, the diode 6 and the secondary coil 3. This current is measured with a sensor 5.

Figure 2:
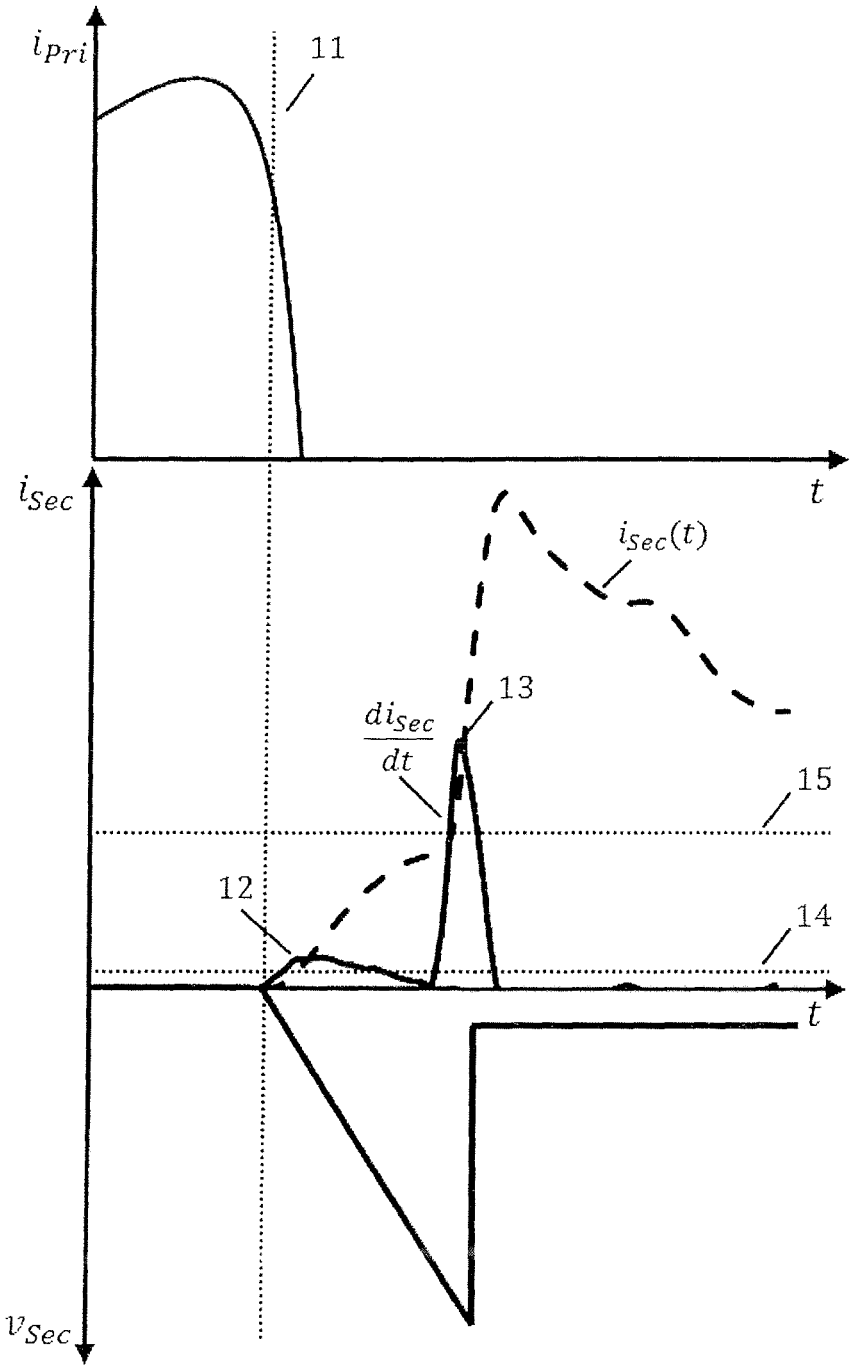
FIG. 2 is a plot of current versus time of a primary and secondary current in accordance with this disclosure.

FIG. 2 shows the primary current $i_{Pri}$, the secondary current $i_{Sec}$, the first time derivative of the secondary current $di_{Sec}/dt$ and the secondary voltage $V_{Sec}$ as a function of time. The time when the switch 4 is opened to interrupt the primary current is schematically indicated by a vertical line 11 in FIG. 2. When the primary current $i_{Pri}$ is switched off by opening switch 4, the secondary voltage $V_{Sec}$ induced in the secondary coil 3 of the transformer increases. As a consequence, a secondary current $i_{Sec}$ begins to flow. The secondary current $i_{Sec}$ is at first rather small and increases slowly. At this stage, a fuel mixture between the electrodes 7*a* and 7*b* has only a low conductivity due to a small number of ions present. When the secondary voltage reaches a critical value, breakthrough is caused between the electrodes 7*a*, 7*b* and a spark discharge forms. When this happens, the secondary current $i_{Sec}$ shows a marked increase. This marked increase of the secondary current $i_{Sec}$ corresponds to a maximum 13 of the first time derivative $di_{Sec}/dt$ of the secondary current $i_{Sec}$.

The time it takes an arc discharge to form after the voltage is applied to the spark plug increases as the spark plug is affected by a wear. Hence, the degree of wear of a spark plug can be characterized by a time interval that is indicative for the time that passes between application of a voltage to the spark plug and formation of an arc discharge between electrodes of the spark plug. FIG. 2 shows that there are several ways to define the beginning and end of such a time interval.

The start of the time interval may be defined as the time when the primary current $i_{Pri}$ is switched off. Another possibility is, for example, to define the start of the time interval to be the time when the secondary current $i_{Sec}$ surpasses a predefined threshold 14 indicated in FIG. 2.

The end of the time interval that is indicative for the time between the application of a voltage to the spark plug and formation of an arc discharge between electrodes of the spark plug can be defined as the time when a secondary current $i_{Sec}$ surpasses a predefined threshold 15 indicated in FIG. 2 or the time when the first time derivative $di_{Sec}/dt$ of the secondary current $i_{Sec}$ surpasses a predefined threshold, for example. Another possibility is to define the end of the time interval to be the time when a maximum 13 of the first time derivative $di_{Sec}/dt$ of the secondary current $i_{Sec}$ occurs.

Figure 3:
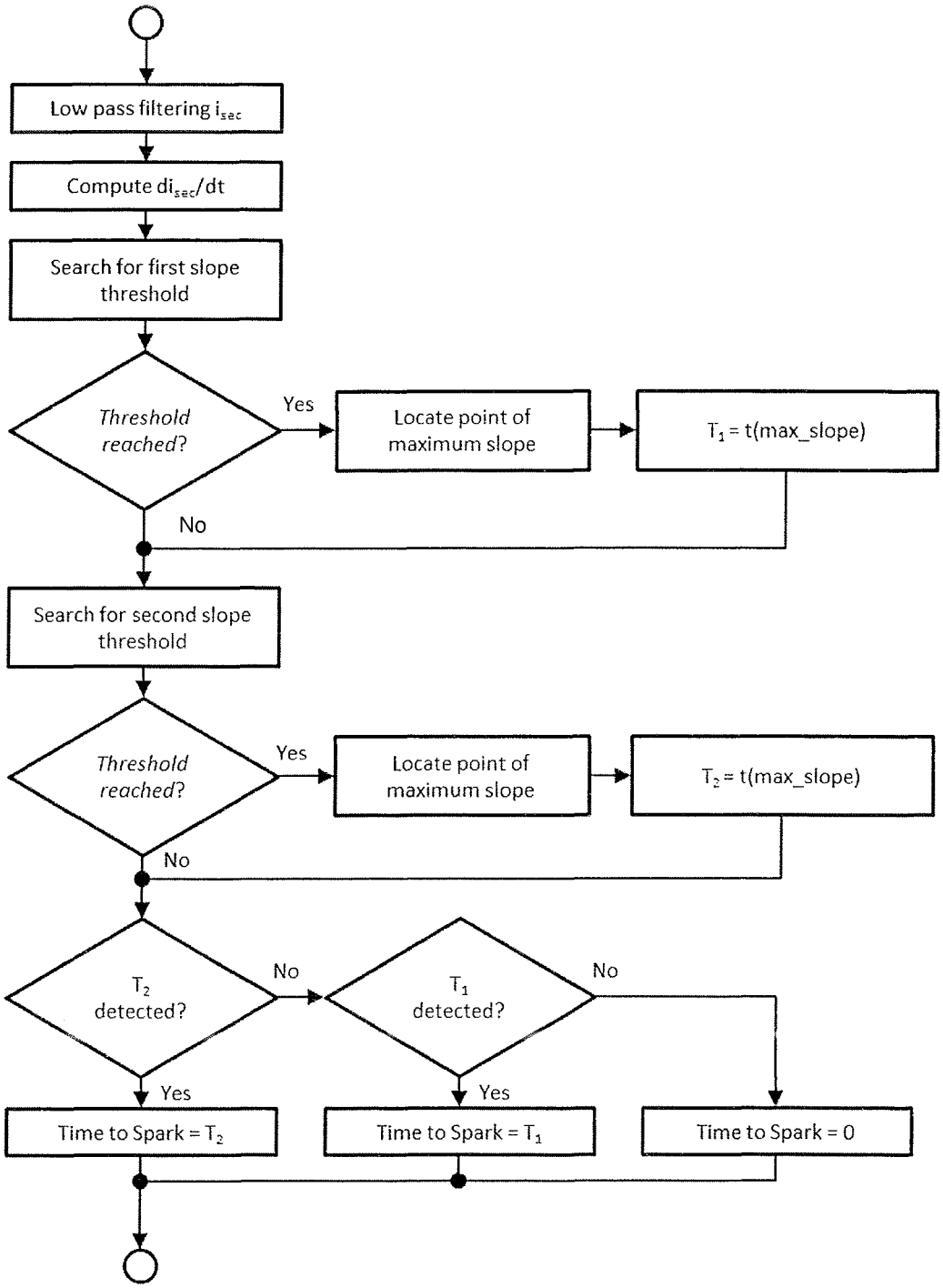
FIG. 3 is a flowchart illustrating a method of determining a need for changing a spark plug according to this disclosure.

FIG. 3 shows a flowchart of an embodiment of a method for determining a need for changing a spark plug of a combustion engine. The method is initiated when the primary current $i_{Pri}$ is switched off and the time t of a time counter set to t=0. The embodiment uses low pass filtering of the signal of the current $i_{Sec}$ flowing through a spark plug 7. Then the first time derivative $di_{Sec}/dt$ of the current $i_{Sec}$ is calculated and it is checked whether the time derivative of the current surpasses a first threshold value 14 indicated in FIG. 2. If so, a search for a maximum is started. A hill climbing algorithm may be used for finding the maximum. The time of the maximum is saved as $t_1$, a possible end of the time interval that is indicative for the time between the application of a voltage to the spark plug and formation of an arc discharge. The maximum found is often a local maximum 12 as indicated in FIG. 2.

In the embodiment shown in FIG. 3, it is then checked whether the first time derivative $di_{Sec}/dt$ of the current $i_{Sec}$ surpasses a second threshold value 15 indicated in FIG. 2. If so, another search for a maximum is started. A hill climbing algorithm may be used for finding the maximum. The time of the maximum is saved as $t_2$ which is the used to define the end of the time interval that is indicative for the time between the application of a voltage to the spark plug and formation of an arc discharge. Thus, $t_2$ is the duration of the time interval. If the first time derivative $di_{Sec}/dt$ of the current $i_{Sec}$ never reaches the second threshold, the time $t_1$ is used as the end of the time interval that is indicative for the time between the application of a voltage to the spark plug and formation of an arc discharge. In this case, $t_1$ is the duration of the time interval. The duration of this time interval is referred to as "time to spark" in FIG. 3. If the time to spark is outside acceptable bounds, a signal is created to indicate the need of a spark plug change. A time that is too short indicates deposit build-up. A time that is too long indicates electrode erosion.

Figure 4:
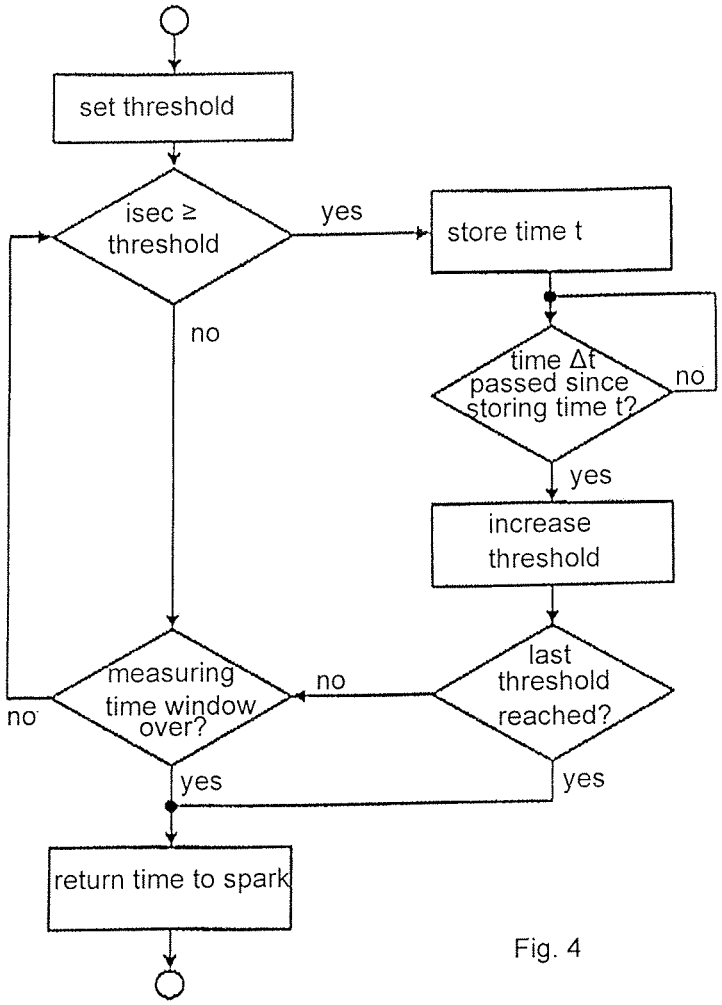
FIG. 4 is a flowchart of another embodiment in accordance with this disclosure.

FIG. 4 shows a flowchart of another embodiment of this disclosure. In this embodiment, the value of the current is used to find the end of the time interval that is indicative for the time that passes between application of a voltage to the spark plug and formation of an arc discharge. The method is initiated when the primary current $i_{Pri}$ is switched off (t=0) and begins by setting an initial threshold for the secondary current $i_{Sec}$. When the threshold is reached the time t that has passed since the method has been initiated is stored. After a time $\Delta t$ the threshold is increased by a predefined amount. When the secondary current $i_{Sec}$ reaches the increased threshold, the time t that has passed since the method has been initiated is stored and the previous value of t is overwritten. After the time $\Delta t$ the threshold is increased again by the predefined amount. This process is repeated until either a time window that has been set for the measurement has passed or a predefined maximum value for the threshold has been reached. The time t provided by this method is the duration of the time interval that is indicative for the time between the application of a voltage to the spark plug and formation of an arc discharge. The duration of this time interval is referred to as "time to spark" in FIG. 4. If the time to spark is outside acceptable bounds, a signal is created to indicate the need of a spark plug change.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. A method for determining a need for changing a spark plug of a combustion engine, comprising:

monitoring a current flowing through the spark plug;

analyzing the current and thereby determining a time interval indicative of the elapsed time between application of a voltage to the spark plug and formation of an arc discharge between electrodes of the spark plug;

determining a start of the time interval wherein the start of the time interval is defined as when a primary voltage is switched off for a transformer which provides a secondary voltage to the spark plug;

determining an end of the time interval wherein the end of the time interval is defined by a maximum of the first time derivative of the current after the first time derivative of the current surpasses the predefined current end threshold value wherein the maximum of the first time derivative of the current is found by:

finding an initial maximum of the first time derivative of the current occurring after the surpassing of the predefined current end threshold value;

determining if the first time derivative of the current surpasses a second threshold value and, if the second threshold value is surpassed, finding a second maximum of the first time derivative of the current; and if the second threshold value is surpassed, setting the end of the time interval as the time when the second maximum of the first time derivative occurred, and, if the second threshold value is not surpassed, setting the end of the time interval as the time when the initial maximum of the first time derivative of the current occurred; and creating a signal indicating a need to change the spark plug if the duration of the determined time interval is larger than a predefined threshold value.

2. Method according to claim 1, wherein the current is low pass filtered before it is analyzed.

3. Method for determining a need to change a spark plug of a combustion engine, comprising:

monitoring a current flowing through the spark plug;

analyzing the current to determine time elapsed between application of a voltage to the spark plug and formation of an arc discharge between electrodes of the spark plug;

determining a start of the time interval wherein the start of the time interval is defined as when the current surpasses a predefined current start threshold;

determining an end of the time interval wherein the end of the time interval is defined by one of the current or the time derivative of the current surpassing a predefined current end threshold value; and signaling the need to change the spark plug if the time elapsed exceeds a predefined minimum value.

4. The method of claim 3 wherein:

the end of the time interval is defined by the time derivative of the current surpassing a predefined current end threshold value.

5. Method for determining a need to change a spark plug of a combustion engine, comprising:

monitoring a current flowing through the spark plug;

analyzing the current and thereby determining a time that passes between application of a voltage to the spark plug and formation of an arc discharge between electrodes of the spark plug;

determining a start of the time interval wherein the start of the time interval is defined as either when a primary voltage is switched off for a transformer which provides a secondary voltage to the spark plug or when the current surpasses a predefined current start threshold;

determining an end of the time interval wherein the end of the time interval is found after the current surpasses a predefined current end threshold value and is defined by an algorithm wherein the time at which the predefined current end threshold value is surpassed is initially set as the end of the time interval, subsequently, an increased threshold value is determined by adding a predefined incremental amount to the predefined current end threshold value and if the current surpasses the increased threshold value within a predefined time period following the surpassing of the predefined current end threshold value, the end of the time interval is updated to correspond to when the current surpassed the increased threshold value, steps of incrementally increasing the threshold and determining if the current has surpassed the increased threshold value within a predefined time period are repeated until the increased threshold value is not surpassed, a maximum time limit is reached or a maximum current value is reached, if a maximum current level is reached, the end of the time interval is defined as when the maximum current level was reached; and creating a signal indicative of the need to change the spark plug if the determined time is outside a predefined time interval.

* * * * *